US011174855B2

(12) United States Patent
Rasnatovski et al.

(10) Patent No.: US 11,174,855 B2
(45) Date of Patent: Nov. 16, 2021

(54) MICRO PUMP AND METHOD FOR MANUFACTURING A MICRO PUMP

(71) Applicant: Plan Optik AG, Elsoff (DE)

(72) Inventors: Alexander Rasnatovski, Siegen (DE); Michael Schilling, Elsoff (DE); Alexander Schilling, Elsoff (DE)

(73) Assignee: PLAN OPTIK AG, Elsoff (DE)

( * ) Notice: Subject to any disclaimer, the term of this patent is extended or adjusted under 35 U.S.C. 154(b) by 226 days.

(21) Appl. No.: 15/673,891

(22) Filed: Aug. 10, 2017

(65) Prior Publication Data

US 2018/0058446 A1 Mar. 1, 2018

(30) Foreign Application Priority Data

Aug. 12, 2016 (DE) ..... 102016115016.9

(51) Int. Cl.

| | |
|---|---|
| ***F04B 43/04*** | (2006.01) |
| ***F04B 53/16*** | (2006.01) |
| ***F04B 45/047*** | (2006.01) |
| ***F04B 53/22*** | (2006.01) |
| *F04B 53/10* | (2006.01) |

(52) U.S. Cl.

CPC ..... *F04B 43/046* (2013.01); *F04B 43/043* (2013.01); *F04B 45/047* (2013.01); *F04B 53/16* (2013.01); *F04B 53/22* (2013.01); *F04B 53/10* (2013.01); *F05B 2230/60* (2013.01)

(58) Field of Classification Search

CPC ..... F04B 53/16; F04B 53/10; F04B 43/046; F04B 45/047; F04B 19/006; F04B 43/02; F04B 43/043

See application file for complete search history.

(56) References Cited

U.S. PATENT DOCUMENTS 3,107,630 A * 10/1963 Johnson ..... F04B 17/003 417/322
3,746,898 A * 7/1973 Austin ..... H04R 7/18 310/326
4,181,477 A * 1/1980 Litt ..... F04B 53/1092 137/512.15
6,104,127 A * 8/2000 Kameyama ..... F04B 43/046 310/324

(Continued)

FOREIGN PATENT DOCUMENTS

CN 1936326 3/2007
CN 1936326 A 3/2007

(Continued)

*Primary Examiner* — Charles G Freay
(74) *Attorney, Agent, or Firm* — Hultquist, PLLC; Steven J. Hultquist

(57) ABSTRACT

A micro pump (10) is provided, wherein the micro pump (10) includes a housing main body (1), a housing upper part (3), a housing lower part (2) and at least one locking structure (4). The housing upper part (3) includes at least one inlet valve (1*a*) and at least one outlet valve (1*b*). The housing upper part (3) is separate from the housing main body (1). The housing lower part (2) is separate from the housing main body (1) and the housing upper part (3), wherein the housing main body (1) is arranged in a sandwich-like manner between the housing upper part (3) and the housing lower part (2), such that the housing upper part (3) is operatively coupled with the housing lower part (2) via the at least one locking structure (4).

13 Claims, 3 Drawing Sheets

(56) References Cited

U.S. PATENT DOCUMENTS

| | | | | |
|---|---|---|---|---|
| 6,382,928 | B1 | 5/2002 | Chang | |
| 7,284,966 | B2 * | 10/2007 | Xu | F04B 19/006 417/395 |
| 8,162,628 | B2 * | 4/2012 | Meng | F04B 43/046 310/311 |
| 8,579,606 | B2 * | 11/2013 | Chen | F04B 43/043 417/413.2 |
| 9,989,047 | B2 * | 6/2018 | Chen | F04B 45/047 |
| 2002/0155010 | A1 | 10/2002 | Karp et al. | |
| 2007/0065309 | A1 * | 3/2007 | Nakajima | F04B 43/023 417/413.1 |
| 2009/0060750 | A1 * | 3/2009 | Chen | F04B 43/043 417/26 |
| 2011/0104024 | A1 * | 5/2011 | Gransee | F16K 99/0013 422/502 |
| 2011/0296722 | A1 * | 12/2011 | Lukas | F04B 43/095 38/77.1 |
| 2013/0331823 | A1 * | 12/2013 | Askem | A61M 1/0088 604/543 |

FOREIGN PATENT DOCUMENTS

| | | | |
|---|---|---|---|
| CN | 204663827 | U | 9/2015 |
| DE | 19948613 | A1 | 4/2001 |
| DE | 102008002675 | A1 | 12/2009 |
| EP | 1052407 | A2 | 11/2000 |
| JP | 100220357 | * | 8/1998 |
| JP | 3808108 | B2 | 5/2006 |
| JP | 3843386 | B2 | 8/2006 |
| JP | 3858134 | B2 | 9/2006 |
| JP | 4419304 | B2 | 12/2009 |
| WO | 0186155 | A1 | 11/2001 |

* cited by examiner

MICRO PUMP AND METHOD FOR MANUFACTURING A MICRO PUMP

CROSS-REFERENCE TO RELATED APPLICATION

This application claims priority under 35 USC § 119 of German Patent Application No. DE 102016115016.9 filed Aug. 12, 2016. The disclosure of such application is hereby incorporated herein by reference in its entirety, for all purposes.

FIELD OF THE INVENTION

The present invention relates to a micro pump and a method for its manufacture. More specifically, the present invention relates to a micro pump with a locking structure and a method for its manufacture.

BACKGROUND OF THE INVENTION

In the state of the art, a number of micro pumps are known, which consist substantially of a housing lower part and a housing upper part, between which a valve diaphragm is arranged, for example from US 2002/155010 A1. From the state of the art, a number of methods are known for bonding the corresponding housing parts of the known micro pumps through an adhesive bond or a welded connection, for example.

The micro pumps known in the state of the art and their manufacturing methods are mostly fairly elaborate and expensive. Further, in micro pumps which are manufactured using a welding seam, there is the risk of the formation of a crack in the welding seam, in particular in the thermal welding method, with the related risk of the presence of liquids through the leaky welding seams. Further, the known micro pumps are substantially limited by their usual manufacturing methods with regard to the choice of materials, for example thermoplastic materials.

The above-described disadvantages of the known technology, in particular the risks involved in the known manufacturing methods for micro pumps, result in a broad potential for improvement.

It is therefore the object of the invention to provide a micro pump of a compact construction type, with variable material choice, with high pumping performance, which can be produced also in large numbers using a cost-effective connecting technique.

SUMMARY OF THE INVENTION

According to the invention, this is achieved by a micro pump in accordance with the features of the main claim 1 and the features of the dependent claim 2, and by a method for manufacturing a micro pump in accordance with the features of the independent claim 15. Preferred embodiments of the invention are specified in the dependent claims.

In view of the known technology and according to a first aspect of the present invention, a micro pump is provided which includes a housing main body, a housing upper part, a housing lower part and at least one locking structure. The housing upper part includes at least one inlet valve and at least one outlet valve. The housing upper part is formed separately or so as to be detached from the housing main body. The housing lower part is formed separately or so as to be detached from the housing upper part, wherein the housing main body is arranged in a sandwich-like manner between the housing upper part and the housing lower part, such that the housing upper part is operatively coupled to the housing lower part via the at least one locking structure.

According to a second aspect of the present invention, a micro pump is provided which includes a housing main body, a housing upper part, a housing lower part and at least one locking structure. The housing upper part is formed separately or so as to be detached from the housing main body. The housing lower part is formed separately or so as to be detached from the housing upper part, wherein the housing main body is arranged in a sandwich-like manner between the housing upper part and the housing lower part, such that the housing upper part is operatively coupled to the housing lower part via the at least one locking structure.

The micro pump can be dimensioned differently in dependence on the application, in order to meet different requirements such as pressure, throughput and volume.

The micro pump according to the second aspect can be configured such that at least one of the housing upper part and the housing lower part includes at least one inlet valve and/or at least one outlet valve.

The micro pump according to the second aspect can be configured such that at least one of the housing upper part and the housing lower part includes at least one inlet valve and the other one of the housing upper part and the housing lower part includes at least one outlet valve.

According to one aspect the micro pump is configured such that the at least one locking structure is formed as a latching mechanism.

According to one aspect the micro pump is configured such that the at least one locking structure is formed as a screw connection.

According to one aspect the micro pump is configured such that the housing main body is formed of a first material and the housing upper part and the housing lower part are formed of a second material that is different from the first material.

According to one aspect the micro pump is configured such that the housing main body is formed of a first material, the housing upper part is formed of a second material and the housing lower part is formed of a third material.

According to one aspect the micro pump is configured such that at least one out of the first material, the second material and the third material is different from the other(s).

According to one aspect the micro pump is configured such that the first material, the second material and the third material are formed from a material chosen from the group consisting of plastic, ceramic, glass and stainless steel. Through the possibility of using different materials, the micro pumps can be adapted for different purposes. It is possible for example to produce both a cost-effective micro pump of inexpensive materials and a micro pump of high-quality materials for special applications. A micro pump for use in an apparatus for highly reactive chemicals is produced of different materials than a pump for de-ionized water, for example.

In one aspect, the micro pump further includes at least one sealing element, at least one diaphragm element and at least one valve element, in particular the valve element is formed as a valve film.

According to one aspect the micro pump is configured such that the at least one sealing element is arranged between the housing main body and the housing upper part and/or the housing lower part.

According to a further aspect of the present invention, a method is provided for manufacturing a micro pump according to any one of the above-specified aspects.

BRIEF DESCRIPTION OF THE DRAWINGS

Further properties and advantages of the invention result from the following, purely illustrative and in no way limiting description of preferred embodiments of the invention with reference to the attached drawings, which are described as follows.

DETAILED DESCRIPTION

Selected embodiments are now described with reference to the drawings. To a skilled person in the field of micro pumps it will become obvious from this disclosure that the following description of the embodiments is provided merely for the purpose of illustration, and not for the purpose of limiting the invention defined by the attached claims and their equivalents.

Since the exact mode of operation of micro pumps for pumping fluids, i.e. gases and liquids and mixtures thereof, is well-known to the expert in the field of pumps, in the following the specific mode of operation is omitted for the sake of brevity, not describing and/or illustrating said mode of operation, but merely describing and/or illustrating its individual components and their mutual arrangement.

Figure 1A:
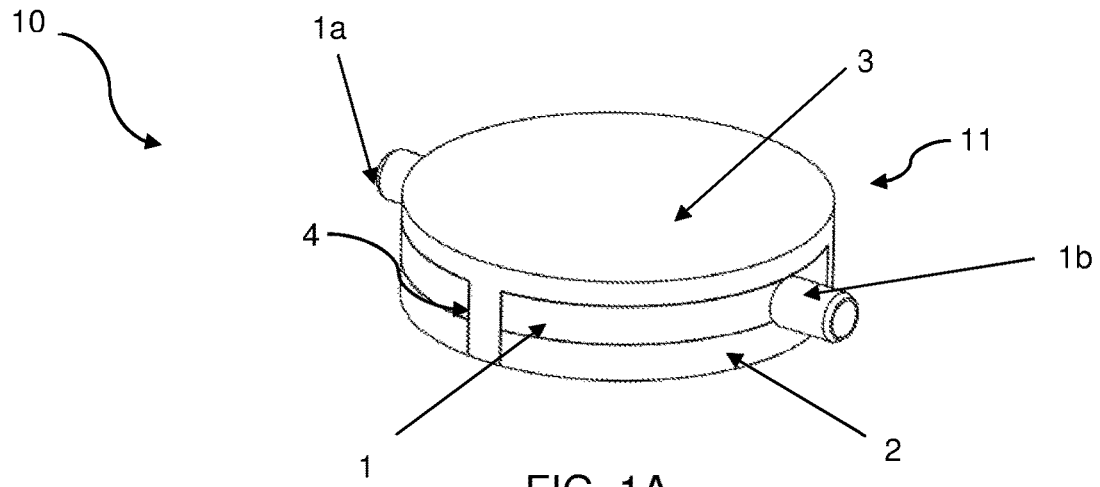
FIG. 1A schematically, a perspective elevation view of a micro pump with a locking structure according to an embodiment of the present invention.
Figure 1B:
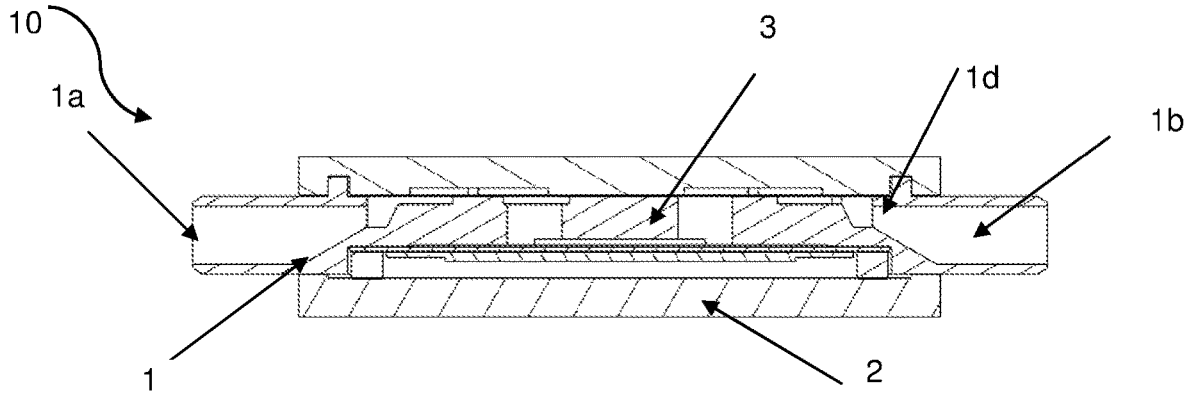
FIG. 1B schematically, a cross-sectional view of the micro pump illustrated in FIG. 1A.

Firstly, making reference to the FIGS. 1A and 1B. Here, a perspective elevation view is shown schematically of a micro pump 10 according to a first embodiment of the present invention. The micro pump 10 here includes substantially a cuboidal housing 11, which preferably has a three-part structure. The housing 11 in the assembled state is formed by a housing main body 1, a housing upper part 3 and a housing lower part 2. The housing main body 1 is formed separately or so as to be detached from both the housing upper part 3 and the housing lower part 2. In the present embodiment the housing upper part 3 is formed as a lid of the housing 11 and the housing lower part 2 is formed as the bottom of the housing 11. However, the present invention is not limited thereto; the housing upper part 3 can also be formed as the bottom of the housing 11 and the housing lower part 2 can also be formed as the lid of the housing 11, if required or desired.

The housing main body 1, the housing upper part 3 and the housing lower part 2 are mutually coupled operatively via at least one locking structure 4, and form a pump chamber in the assembled state. The at least one locking structure 4 therein is formed as a latching mechanism with a clip connection, as explained in the following. In particular, the housing main body 1 is arranged in a sandwich-like manner between the housing upper part 3 and the housing lower part 2, such that the housing upper part 3 is operatively coupled with the housing lower part 2 via the at least one locking structure 4. In particular, the housing main body 1 is arranged in a sandwich-like manner between the housing upper part 3 and the housing lower part 2, such that the housing upper part 3 is operatively coupled detachably with the housing lower part 2 via the at least one locking structure 4.

As can be seen in FIG. 1A, the housing main body 1 includes an inlet 1*a* (feed) and an outlet valve 1*b* (discharge) which is disposed opposite the inlet valve 1*a*. However, the present invention is not limited thereto; the inlet 1*a* and the outlet valve 1*b* of the housing main body 1 can also be arranged offset from one another, if required and/or desired. The inlet 1*a* and the outlet 1*b* are configured such that tubing (not shown) can be connected thereto.

Figure 1C:
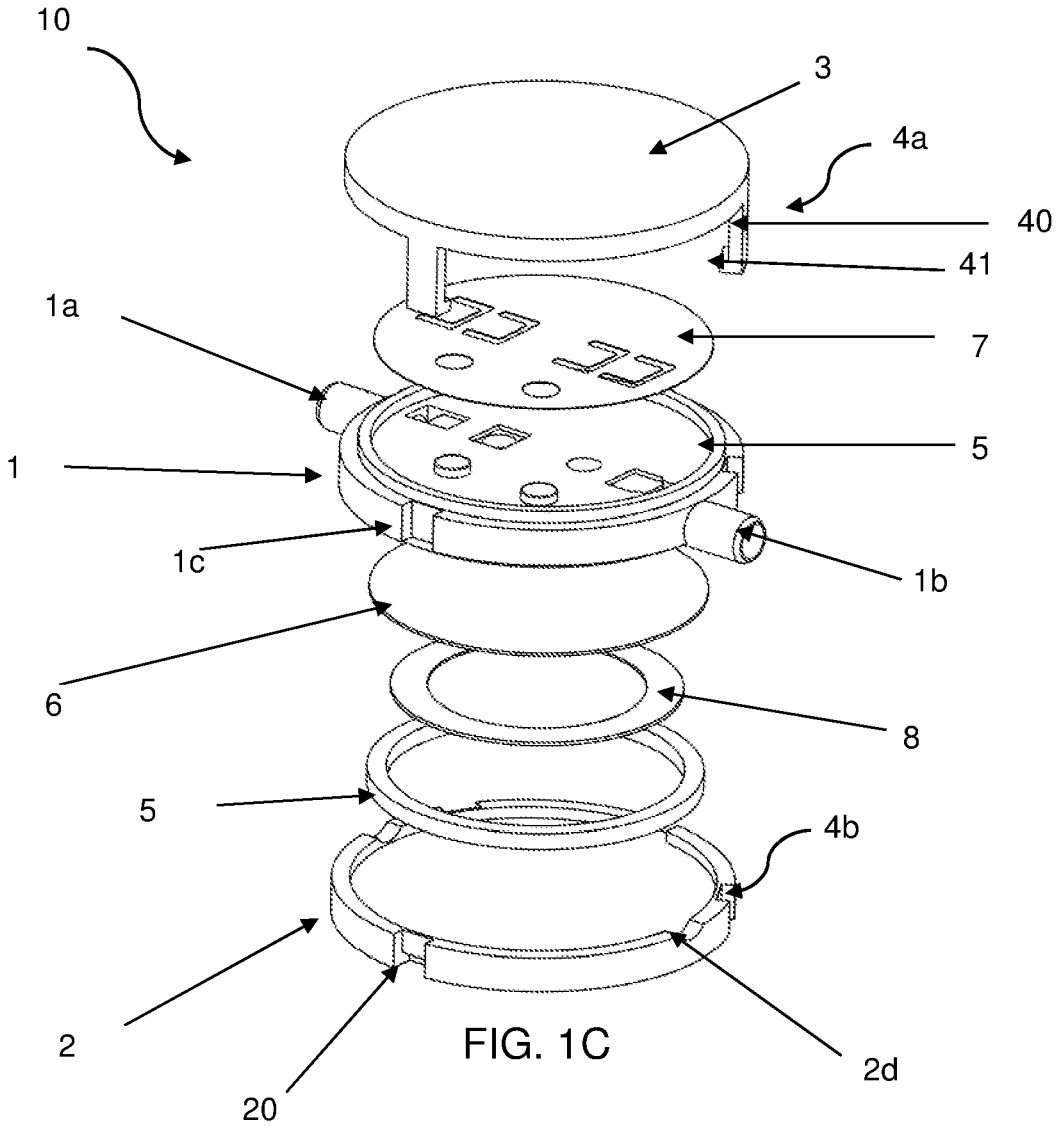
FIG. 1C a schematic exploded view of the micro pump with the locking structure illustrated in FIG. 1A.

As schematically shown in the exploded view of FIG. 1C, the locking structure 4 according to the present embodiment includes four locking elements 4*a*, which are arranged in mutually opposite pairs on the longitudinal sides of the housing upper part 3 at equal spacing from each other. Preferably, the four locking elements 4*a* are formed as latch pins, each having a lug 40 with at least one hook 41, wherein the lugs 40 each project vertically from the surface of the housing upper part. The hooks 41 are arranged on the free ends of the lugs 40 in the plug in direction, wherein the hooks 41 form an angle to the lugs 40. Preferably, the lugs 40 with the corresponding hooks 41 are formed in the shape of an inverse L, which are formed integrally with the housing upper part 3. However, the present invention is not limited thereto; the locking elements 4 can have any shape or inclination deemed suitable by the person skilled in the art, and can also be formed separately with the housing upper part 3, if required and/or desired.

The housing main body 1 has locking recesses 1*c* arranged in mutually opposite pairs, circumferentially on the longitudinal sides of the housing main body 1. The locking recesses 1*c* are configured such that they are aligned with the locking elements 4 of the housing upper part 3 when the housing main body 1 is or is being positioned on the housing lower part 2. Accordingly, the locking recesses 1*c* are configured such that upon placement, the housing main body 1 is substantially flush with the housing upper part 3, and the locking elements 4 extend at least partially through the locking recesses 1*c*.

Further, the housing main body 1 has at least one positioning projection 1*d* for relative adjustment with the housing upper part 3, which projects from the surface of the housing main body 1. The positioning projection 1*d* is or becomes engaged with a corresponding positioning recess 2*d* formed on the lower side of the housing lower part 2, in a state in which the housing main body 1 is positioned onto the housing lower part 2. Accordingly, the positioning projection 1*d* and the positioning recess 2*d* ensure a substantially flush orientation of the housing lower part 2 with the housing main body 1. Accordingly, the housing main body 1, the housing upper part 3 and the housing lower part 2 are substantially flush in the assembled state.

As can be seen in FIG. 1C, the locking structure 4 further includes at least four engagement elements 4*b*, which are formed as counterpart of the locking elements 4*a*. In particular, the engagement elements 4*b* are formed as teeth 20 or lugs which are arranged fully circumferentially on the housing lower part 2 and are configured such that these can be latched with the corresponding hooks 40 of the respective locking elements 4*a*. Accordingly, the teeth 20 form the corresponding counterparts of the hooks 40. Corresponding to the locking elements 4*a*, the teeth 20 are arranged in mutually opposite pairs on the longitudinal sides of the housing lower part 2 at equal spacing from each other. Further, as can be seen in FIG. 1A, the length of the lugs 40 is dimensioned such that the hooks 41 can be latched to the teeth 20 in the assembled state. However, the present invention is not limited thereto; the locking structure 4 could also be formed as a screw connection.

Further, as shown in FIG. 1A, the micro pump 10 further includes at least one sealing element 5, at least one diaphragm element 6, at least one valve element 7 and at least one actuator 8. In the present embodiment, at least one sealing element 5 having at least one diaphragm element 6 and the at least one actuator 8 are arranged between the housing main body 1 and the housing lower part 2, in a state in which the housing 11 is in the assembled state. Further, in the present embodiment at least one sealing element 5 and the at least one valve element 7 are arranged between the housing main body 1 and the housing upper part 3, in a state in which the housing 11 is in the assembled state. In the present embodiment, the sealing elements 5 are formed as sealing rings, in particular as rubber rings. Further, in the present embodiment the diaphragm element 6 is formed as a conventional pump diaphragm 6.

In the present embodiment, the actuator 8 is formed as a piezo actuator 8, as an apparatus for deflecting the pump's diaphragm 6. In particular, the actuator 8 can be formed as a piezoelectric, thermoelectric or thermal element. The piezo actuator 8 can be connected to the pump diaphragm 6 by adhesion, for example. Further, in the present embodiment the valve element 7 is formed as a valve film 7 (valve diaphragm), which is arranged between the housing main body 1 and the housing upper part 3, in which at least one perforated structure is formed in the region of the inlet and outlet 1*a*, 1*b*. The pump diaphragm and/or the valve diaphragm consist of plastic for example, in particular polycarbonate, PFA or other chemically inert and/or bio-compatible materials. A bending of the piezo actuator is induced by an applied voltage. This leads to a deflection of the pump diaphragm and to the change of the volume in the pump chamber.

As can be seen in FIG. 1A, for accommodating the individual components, i.e. the pump diaphragm 6, sealing ring 5, piezo element 8, valve diaphragm 7, complementary structures, such as blind holes or grooves are formed in the housing main body 1, housing upper part 3 and housing lower part 2, in order to ensure a compact construction type and high pumping performance.

The housing main body 1, the housing upper part 3 and the housing lower part 2 can be formed of different materials. In the present embodiment, the housing main body 1 is formed of a first material and the housing upper part 3 and the housing lower part 2 are formed of a second material different from the first material. However, the present invention is not limited thereto; the housing main body 1 can be formed of a first material, the housing upper part 3 can be formed of a second material and the housing lower part 2 can be formed of a third material, wherein the first material is different from the second material and the second material is different from the third material.

In the present embodiment, the first, second and third materials are chosen from a plastic, for example polycarbonate, ceramic, glass, for example borosilicate glass, and stainless steel. Further, at least one of the first, second and third materials can be chosen from a crosslinkable plastic or composite material. Accordingly, in the present invention the micro pump 10 can be realized through a crimp connection of different materials or other materials than in conventional micro pumps.

Figure 2A:
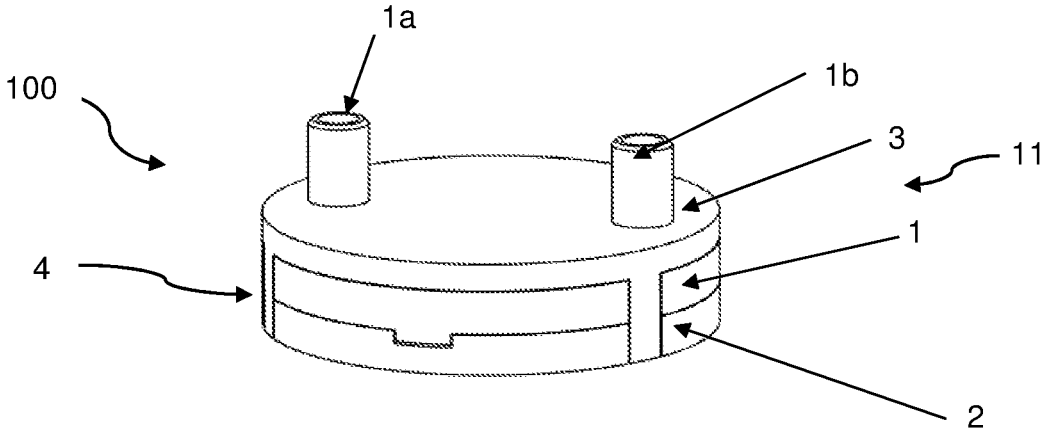
FIG. 2A schematically, an elevation view of a micro pump with a locking structure according to a further embodiment of the present invention.
Figure 2B:
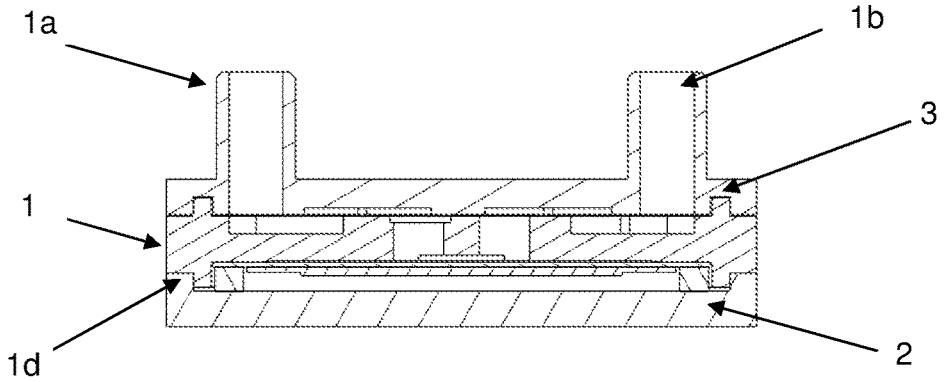
FIG. 2B schematically, a cross-sectional view of the micro pump illustrated in FIG. 2A.
Figure 2C:
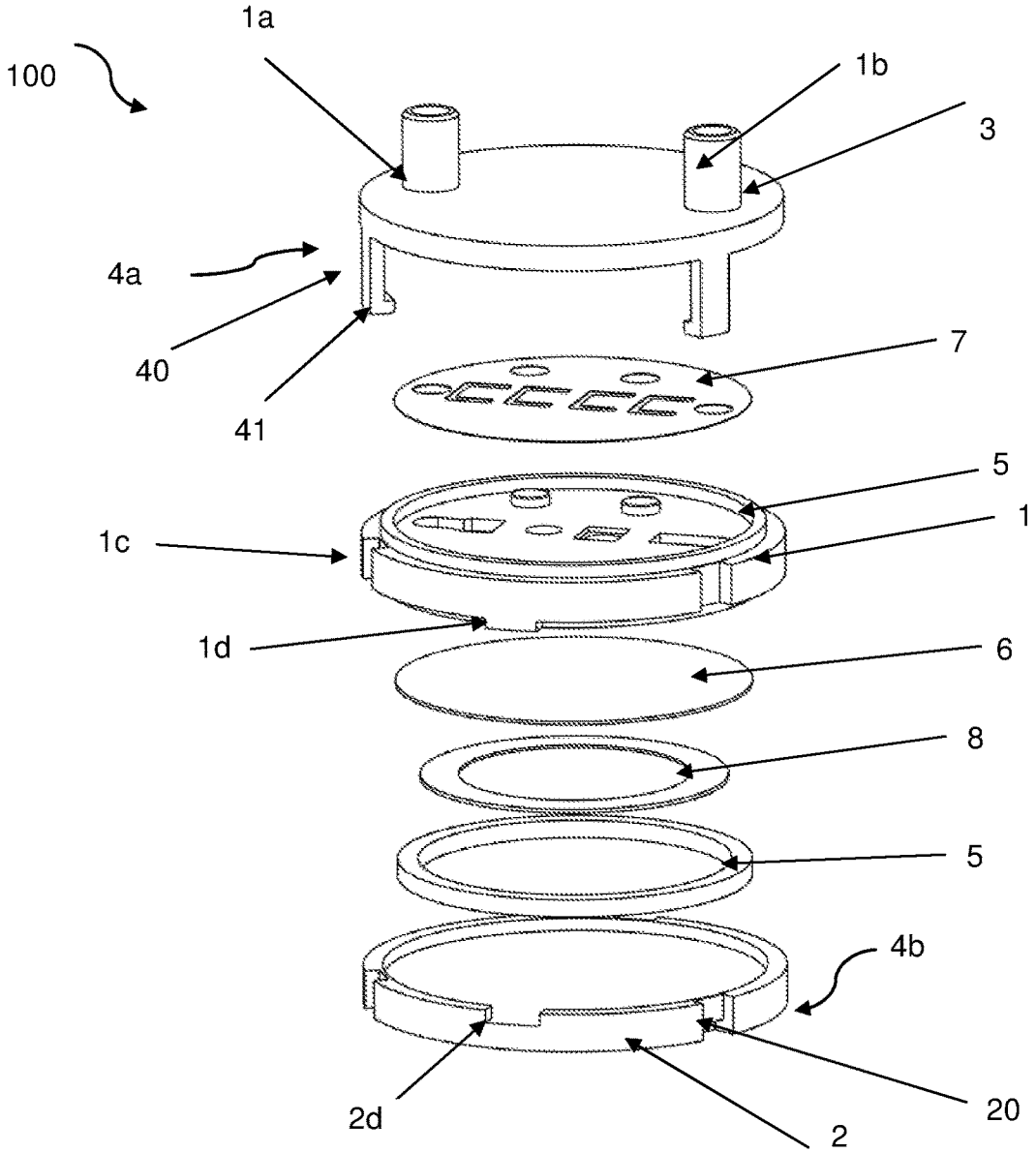
FIG. 2C a schematic exploded view of the micro pump with the locking structure illustrated in FIG. 2A.

Now making reference to FIGS. 2A, 2B and 2C. There, a micro pump 100 according to a second embodiment of the present invention is shown. The micro pump 100 has substantially the same configuration as the micro pump 10 of the first embodiment, with the exception of the arrangement of the inlet and outlet valves 101*a* and 101*b*. Consequently, those elements which have substantially the same function as such in the first embodiment are marked with the same reference numbers and are not again described and/or illustrated herein in detail for the sake of brevity.

As shown in FIG. 2A, the housing upper part 3 has an inlet 1*a* (feed) and an outlet 1*b* (discharge) which is disposed opposite the inlet 1*a*. However, the invention is not limited thereto; the inlet 1*a* and the outlet 1*b* of the housing upper part 3 can also be arranged offset from one another, if required and/or desired. The inlet 1*a* and the outlet 1*b* are configured such that tubing can be connected thereto. The inlet 1*a* and the outlet 1*b* project from the surface of the housing upper part 3. Correspondingly, the valve element 7 is arranged between the housing main body 1 and the housing upper part 3 in a state in which the housing 11 is in an assembled state. Further, in the present embodiment at least one sealing element 5, the at least one diaphragm element 6 and the at least one piezo actuator 8 are arranged between the housing main body 1 and the housing lower part 2, in a state in which the housing 11 is in an assembled state. However, the invention is not limited thereto; the inlet 1*a* and the outlet 1*b* can also project from the surface of the housing lower part 2, if required and/or desired. Further, at least one of the housing upper part 3 and the housing lower part 2 could include at least one inlet valve, and the other one of the housing upper part 2 and the housing lower part 3 could include at least one outlet valve.

Further, as can be seen in FIG. 2C, here the housing main body 1 has at least one positioning projection 1*d* for relative adjustment with the housing lower part 2, which projects from the lower surface of the housing main body 1. The positioning projection 1*d* is or becomes engaged with a corresponding positioning recess 2*d*, which is formed on the surface of the housing lower part 2 here, in a state in which the housing main body 1 is positioned onto the housing lower part 2. Accordingly, the positioning projection 1*d* and the positioning recess 2*d* ensure a substantially flush orientation of the housing lower part 4 with the housing main body 1. Accordingly, the housing main body 1, the housing lower part 2 and the housing upper part 3 are substantially flush in the assembled state.

While merely some selected embodiments have been chosen to describe the present micro pump and method for manufacturing a micro pump, persons skilled in the art will understand on the basis of this disclosure that various changes and modifications can be carried out here without deviating from the scope of the invention as defined in the attached claims.

LIST OF REFERENCE NUMBERS

1 housing main body
1*a* inlet
1*b* outlet
1*c* locking recess
1*d* positioning projection
2 housing lower part
2*d* positioning recess
3 housing upper part
4 locking structure
4*a* locking element
4*b* engagement element
5 sealing element

6 diaphragm element
7 valve element
8 actuator
10,100 micro pump
11 housing
20 tooth
40 lug
41 hook

The invention claimed is:

1. A micro pump, comprising:

a housing main body;

a housing upper part separate from the housing main body;

a housing lower part separate from the housing main body and the housing upper part, wherein the housing main body is arranged in a sandwich-like manner between the housing upper part and the housing lower part, such that the housing upper part is operatively coupled with the housing lower part via at least one locking structure, wherein the locking structure is integrally formed with the housing upper part, and wherein the housing main body is formed of a first material, the housing upper part is formed of a second material and the housing lower part is formed of a third material, and wherein the second material of the housing upper part is different from the first material and the third material, and wherein the housing upper part, the housing main body, and the housing lower part are arranged in a vertically stacked arrangement in which their respective outer edges are vertically aligned with one another; and a valve element, which is arranged between the housing main body and the housing upper part, and wherein the valve element comprises at least one valve film.

2. The micro pump according to claim 1, wherein at least one of the housing upper part and the housing lower part has at least one inlet and at least one outlet.

3. The micro pump according to any one of claims 1 and 2, wherein the at least one locking structure is formed as a latching mechanism.

4. The micro pump according to any one of claims 1 and 2, wherein the at least one locking structure comprises engagement elements engageable with locking elements.

5. The micro pump according to any one of claims 1 and 2, wherein the first material of the housing main body is different from the third material of the housing lower part.

6. The micro pump according to claim 1, wherein the first material, the second material and the third material is/are formed at least from a material chosen from the list consisting of plastic, ceramic, glass and stainless steel.

7. The micro pump according to any one of claims 1 and 2, further comprising at least one sealing element.

8. The micro pump according to any one of claims 1 and 2, further comprising at least one diaphragm element.

9. The micro pump according to claim 7, wherein the at least one sealing element is arranged between the housing main body and at least one of the housing upper part or the housing lower part.

10. The micro pump according to claim 7, wherein the at least one sealing element includes plural sealing elements, and at least one sealing element is arranged between each of the housing main body and the housing upper part and the housing main body the housing lower part.

11. The micro pump according to claim 1, wherein at least one of the housing upper part and the housing lower part has at least one inlet valve or at least one outlet valve.

12. The micro pump according to claim 1, wherein the housing upper part, the housing main body, and the housing lower part each comprise a cylindrical body form.

13. The micropump according to claim 12, wherein the cylindrical body, form of each of the housing upper part, the housing main body and the housing lower part have an equal outer diametric dimension.

* * * * *